US005241922A

United States Patent [19]

Allen

[11] Patent Number: 5,241,922

[45] Date of Patent: Sep. 7, 1993

[54] COLLAPSIBLE SEA ANCHOR

[76] Inventor: Susie M. Allen, 7345 Seattle St., Bay City, Oreg. 97107-9633

[21] Appl. No.: 789,092

[22] Filed: Nov. 7, 1991

[51] Int. Cl.[5] ..... B63B 21/48

[52] U.S. Cl. ..... 114/311

[58] Field of Search ..... 114/294, 311; 244/113, 244/145 R, 1 TD, 138 R

[56] References Cited

U.S. PATENT DOCUMENTS

| | | | |
|---|---|---|---|
| 717,890 | 1/1903 | Miller | 114/311 |
| 1,960,846 | 5/1934 | Hein | 114/311 |
| 2,409,562 | 10/1946 | Hastings | 244/145 |
| 2,818,042 | 12/1957 | Manhart | 114/311 |
| 4,481,900 | 11/1984 | Rutten et al. | 114/311 |
| 4,632,051 | 12/1986 | Raymond et al. | 114/311 |
| 4,637,330 | 1/1987 | Shewmon | 112/417 |
| 5,025,746 | 6/1991 | Boulter | 114/311 |

FOREIGN PATENT DOCUMENTS

| | | | |
|---|---|---|---|
| 1435960 | 12/1966 | France | 244/1 TD |
| 2165198 | 4/1986 | United Kingdom | 114/311 |

*Primary Examiner*—Sherman Basinger

*Attorney, Agent, or Firm*—Kolisch, Hartwell, Dickinson, McCormack & Heuser

[57] ABSTRACT

The invented sea anchor is made from two sheets of flexible material sewn together to create a generally frustum-shaped body. The body is collapsible and has a first end defining a first opening of a predetermined dimension and a second end defining a second opening of a predetermined dimension smaller than the predetermined dimension of the first opening. The anchor includes at least one fin mounted on, projecting outward from, and extending in an axial direction along the frustum-shaped body. The anchor also includes a flexible stiffener encircling a portion of the first opening. The anchor may also include strapping joined to and extending transversely and axially across the frustum-shaped body. The transversely extending strapping may interconnect a plurality of fins.

4 Claims, 2 Drawing Sheets

COLLAPSIBLE SEA ANCHOR

TECHNICAL FIELD

This invention relates to anchors. More particularly, this invention relates to drag anchors or sea anchors dragged behind a boat.

BACKGROUND ART

A sea anchor is a large, usually canvas-covered conical frame let out from a ship as a drag or float to reduce drifting or to keep the ship heading into the wind. The anchor creates a drag on the boat from water moving through the anchor. The drag keeps the boat facing into the wind. It also affects the rate of drift of a boat, either increasing or decreasing the rate depending on the water and wind currents. Sea anchors are also used for trolling or simply to control a boat's speed.

U.S. Pat. No. 4,481,900 to Rutten et al. discloses a sea anchor. Specifically, it shows a cylindrical body of cloth with large and small circular openings at respective ends of the body. U.S. Pat. No. 4,632,051 to Raymond et al. shows another sea anchor. That anchor has a paraboloid shape with one open end and one closed end. It is constructed from a webbing. U.S. Pat. No. 2,818,042 to Manhart and U.S. Pat. No. 717,890 to Miller both show other types of sea anchors. U.S. Pat. No. 4,637,330 to Shewmon discloses a reinforced seam and sewing method which can be used in constructing a sea anchor.

Present sea anchors, however, tend to spin or rise to the surface of the water. Additionally, many of the collapsible sea anchors have difficultly maintaining their shape in the water. Finally, many sea anchors are heavy, cumbersome and difficult to manipulate and store. This invention addresses those shortcomings.

DISCLOSURE OF THE INVENTION

The invented sea anchor is made from two sheets of flexible material sewn together to create a generally frustum-shaped body. The body is collapsible and has a first end defining a first opening of a predetermined dimension and a second end defining a second opening of a predetermined dimension smaller than the predetermined dimension of the first opening. The anchor includes at least one fin mounted on, projecting outward from, and extending in an axial direction along the frustum-shaped body. The anchor also includes a flexible stiffener encircling the first opening. The anchor may also include strapping joined to and extending transversely and axially across the frustum-shaped body. The transversely extending strapping may interconnect a plurality of fins.

DETAILED DESCRIPTION AND BEST MODE FOR CARRYING OUT THE INVENTION

Figure 1:
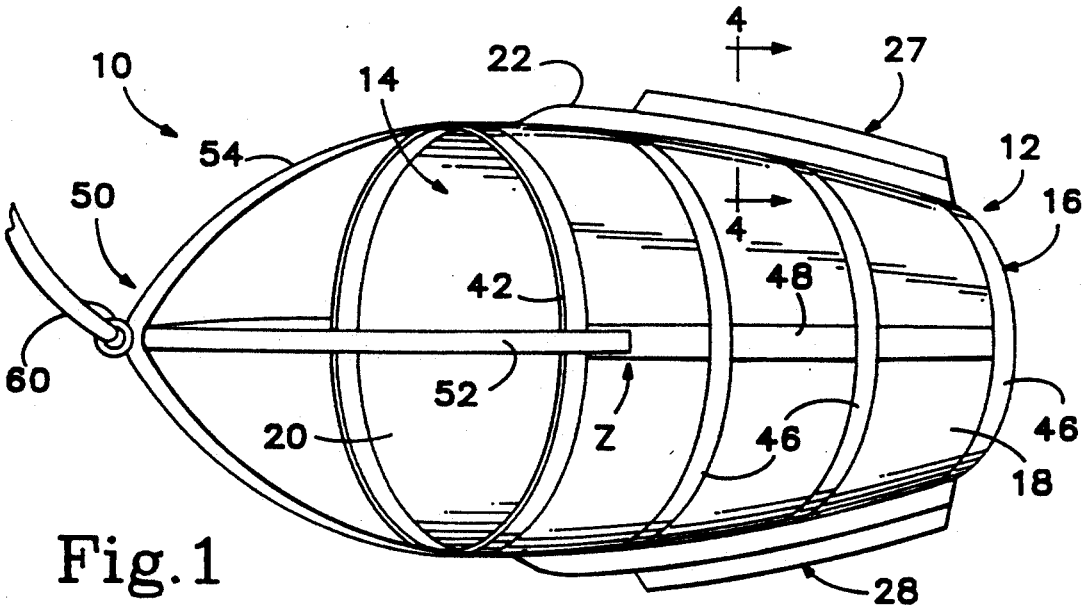
FIG. 1 is a perspective view of the invented sea anchor.

The preferred embodiment of the invented anchor is shown generally at 10 in FIG. 1. The anchor includes a generally frustum-shaped body 12. In other words, body 12 has a generally conical or funnel shape.

Body 12 has a first end 14 and a second end 16. The first end defines a first opening of a predetermined dimension. The second end defines a second opening also of a predetermined dimension, but the second end's opening is smaller than the first opening. In other words, body 12 tapers from first end 14 towards second end 16 so that it has a frustum shape.

As anchor 10 is dragged behind a boat, water enters the anchor at first end 14 and exits the anchor at second end 16. Because the anchor's first opening is larger than the anchor's second opening, the anchor creates a drag, similar to pulling a funnel through the water.

In the preferred embodiment, body 12 is constructed from a first flexible sheet 18 and a second flexible sheet 20 joined together. Each sheet has first and second ends and tapers from its first end to its second end, respectively.

Figure 4:
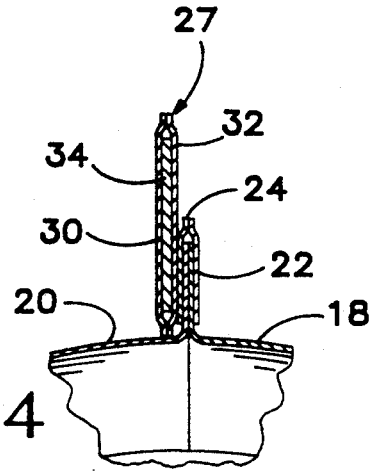
FIG. 4 is a cross-sectional view of a part of the invented anchor taken along the line 4—4 in FIG. 1.

As shown in FIG. 4, first sheet 18 and second sheet 20 are joined together and enclosed by two strips of flexible fabric webbing, 22 and 24. In the preferred embodiment, strips 22 and 24, and sheets 18 and 20 are sewn together, as shown at 26 in FIG. 5. Of course, numerous other methods can be used to join sheets 18 and 20. In the preferred embodiment, sheets 18 and 20 are constructed from a flexible material non-porous to water, such as vinyl. The sheets combine to form a water impervious and non-perforated shell. Alternatively, any flexible material such as canvas or cloth may be used.

Figure 2:
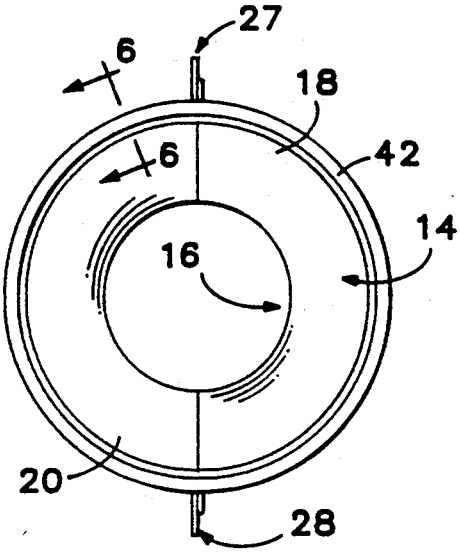
FIG. 2 is a front and plan view of the invented anchor.
Figure 3:
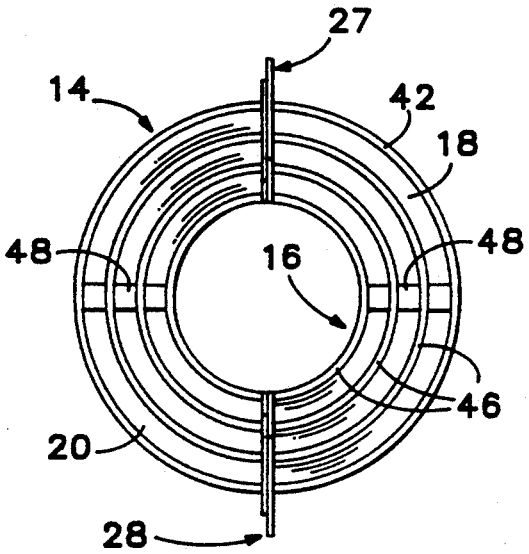
FIG. 3 is a rear end plan view of the invented anchor.

FIG. 2 is a front plan view of the invented anchor, showing the interior of sheets 18 and 20. FIG. 2 also shows the respective dimensions of the first and second openings. FIG. 3 is a back plan view of the invented anchor, looking toward second opening 16.

The preferred embodiment of anchor 10 includes two fins 27 and 28 mounted on body 12. Both fins project outward from and extend in an axial direction along body 12. The fins can be of varying lengths and heights. The fins are oriented so that they present little if any resistance when the anchor is dragged or pulled through the water. However, because the fins extend axially along the anchor's body, the fins tend to keep the anchor running straight and they tend to prevent or hinder the anchor from spinning. As the anchor spins, the fins provide resistance against the water, thereby limiting the spin. Fins 27 and 28 are positioned equally circumferentially around body 12. Other embodiments have only one fin or any number of fins mounted on anchor 10. Typically the fins will be mounted symmetrically on the anchor, but that is not essential.

Figure 5:
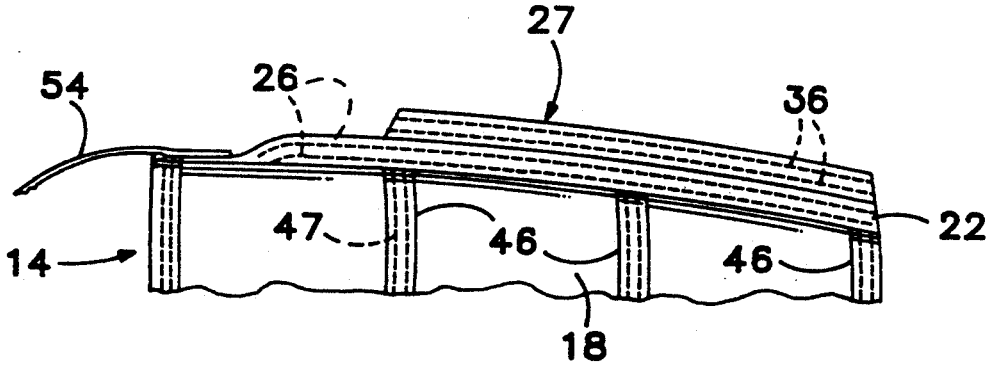
FIG. 5 is a side plan view of part of the invented anchor.

A cross-sectional view of fin 27 is shown in FIG.4. The fin includes a first strip of flexible webbing 30, a second flexible webbing strip 32 and a stiffening strip 34 sandwiched between strips 30 and 32. Strips 30, 32 and 34 are sewn together as shown at 36 in FIG. 5. Fin 27 is then sewn onto strip 22 either by stitching 26, as shown in FIG. 5, or by additional stitching. Stitching 36 and 26 is not shown in FIG. 4 for simplification.

Fin 28, in the preferred embodiment, is constructed in the same manner as fin 27. Of course, the fins can be constructed in many different ways from many different materials. The important part of the invention is to have fins that direct the anchor while it is pulled or dragged through the water and that tend to prevent the anchor from spinning.

Figure 6:
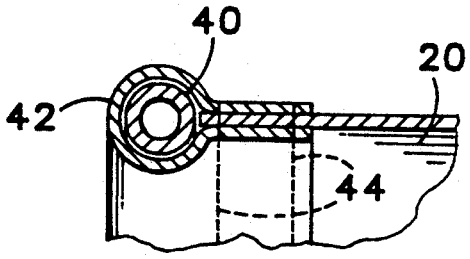
FIG. 6 is a cross-sectional view of a portion of the invented anchor, taken along the lines 6—6 in FIG. 2.

The first opening defined by first end 14 is supported by a flexible stiffener 40 shown in FIG. 6. Stiffener 40 is enclosed in a flexible material webbing 42 looped around the stiffener and joined to sheets 18 and 20. In the preferred embodiment, webbing 42 is joined to sheets 18 and 20 by stitching, such as shown at 44 in Fig. 6.

Stiffener 40, in the preferred embodiment, is a flexible, rubber tubing. Different stiffeners or different tubing with various stiffnesses can be used. Stiffener 40 functions to help maintain the opening defined by first end 14 open. Nonetheless, stiffener 40 is still flexible so that the anchor can collapse for easy storage and handling. Ideally, stiffener 40 prevents the opening defined by first end 14 from completely closing so that when the anchor is thrown into the water, some water will enter into the opening and force the anchor open. Additionally, because the flexible stiffener keeps first end 14 from completely closing, it keeps the anchor in the water and tends to keep it from bailing out. This also may be due, in part, because the flexible stiffener presents a configuration that digs into the water. In the preferred embodiment, stiffener 40 entirely encircles the first opening. However, it is only necessary that the stiffener encircle a portion of the first opening sufficient to keep the opening from closing completely. In some embodiments the stiffener will encircle a major portion of the opening.

The preferred embodiment of anchor 10 includes support strapping 46 joined to and extending transversely across the body. As shown in FIG. 5, the support strapping is stitched to the body, as shown at 47. The anchor also includes support strapping 48 extending axially across body 12. Strip 48 is also sewn to body 12, as shown at 49 in FIG. 7. Strappings 46 and 48 strengthen body 12, thus allowing for an anchor of lower mass while maintaining anchor strength. Additional, strappings 46 and 48 inhibit tearing in sheets 18 and 20. Support strappings 46 may also interconnect fins 27 and 28, giving the anchor structural integrity and strength while supporting the the fins. Any number of support straps or any placement of them on the anchor's body may be used.

Anchor 10 also includes a bridal or connecting strap system 50. Connecting strap system 50 includes a first strap 52 and a second strap 54. Each strap has two ends, and the end are positioned symmetrically around first end 14. A tow line, such as line 60, is connected to system 50 and to a boat.

Figure 7:
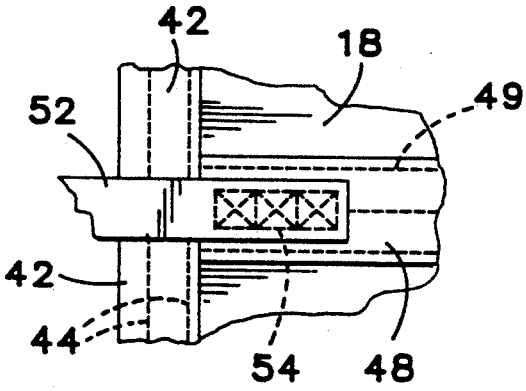
FIG. 7 is a magnified view of a portion of the invented anchor identified at Z in FIG. 1.

FIG. 7 shows an enlarged view of how strap 52 is joined to body 12. Specifically, strap 52 is stitched onto sheet 18 and support strapping 48 by stitching 54. Thus, support strapping 48 also provided strength for the pull point of strap 52. The other end of strap 52 and the ends of strap 54 are connected to the anchor in a similar fashion. Additional strapping may be positioned under strap 48 or on the other side of sheet 18 to strengthen the anchor.

INDUSTRIAL APPLICABILITY

Figure 8:
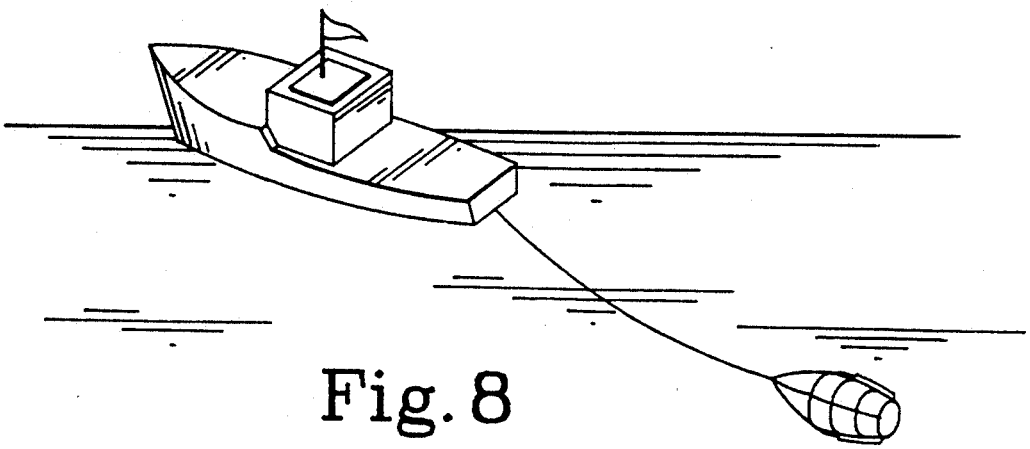
FIG. 8 is an environmental view showing the anchor in use.

The invented anchor is applicable in the boating and fishing industries. It is also applicable in the shipping, towing and rescue boat industries where a vessel typically encounters high seas and strong winds. The anchor is used by attaching a line from a boat to connecting strap system 50, as shown in FIG. 8. The anchor is then dragged behind the boat or thrown into the current so that the current drags the anchor behind the boat. While a preferred embodiment of the invention have been described, changes and modifications may be made without departing from the spirit of the invention.

I claim:

1. A sea anchor comprising:

a general frustum-shaped hollow body having an open large diameter end and an open small diameter end and a tapered outline extending between said ends;

at least two elongate fins mounted on and projecting outward from said body, the fins extending in an axial direction that parallels the taper of the frustum-shaped body and serving to stabilize the anchor from spinning about its axis;

said fins positioned equally circumferentially around the generally frustum-shaped body;

said generally frustum-shaped body being collapsible; and said generally frustum-shaped-body comprising first and second flexible sheets sewn together in an elongate sewn region that extends axially on the frustum-shaped body and that parallels the taper of the body, said fins secured to the body with sewing that extends along said sewn region.

2. A sea anchor comprising:

a generally frustum-shaped and collapsible hollow body having first and second ends, where the first end has an extended condition defining a first opening of a predetermined dimension and the second end has an extended condition defining a second opening of a predetermined dimension smaller than the predetermined dimension of the first opening;

at least one fin mounted on, projecting outward from, and extending in an axially direction along the frustum-shaped body;

the fin and axis of the body extending in a common plane and the fin serving to stabilize the anchor from spinning about its axis; and a flexible stiff rubber element encircling at least a major portion of the first opening serving resiliently to urge the first opening to its extended condition.

3. A sea anchor comprising:

a generally frustum-shaped hollow body having an open large diameter end and an open small diameter end and a tapered outline extending between said ends;

at least two elongate fins mounted on and projecting outward from said body, the fins extending in an axial direction that parallels the taper of the frustum-shaped body and serving to stabilizing the anchor from spinning about its axis: and said frustum-shaped body is collapsible and made of flexible sheet material, and which further comprises an elongate stiff rubber element encircling the large diameter end of said body serving yieldably to extend said large diameter end of said body.

4. The anchor of claim 2 wherein the collapsible body is formed of flexible sheet material, and wherein the fin is at least partially formed by an elongate region of double thickness of the sheet material, stitching extending along the region of double thickness of sheet material holding the sheet material in said region together.

* * * * *